US009182723B2

(12) United States Patent
Miyazaki

(10) Patent No.: US 9,182,723 B2
(45) Date of Patent: Nov. 10, 2015

(54) IMAGE FORMING APPARATUS

(75) Inventor: Masahiko Miyazaki, Osaka-shi (JP)

(73) Assignee: Kyocera Mita Corporation (JP)

( * ) Notice: Subject to any disclaimer, the term of this patent is extended or adjusted under 35 U.S.C. 154(b) by 1495 days.

(21) Appl. No.: 12/358,477

(22) Filed: Jan. 23, 2009

(65) Prior Publication Data

US 2009/0190986 A1 Jul. 30, 2009

(30) Foreign Application Priority Data

Jan. 25, 2008 (JP) ..... 2008-014561

(51) Int. Cl.
*G03G 15/00* (2006.01)

(52) U.S. Cl.
CPC .. *G03G 15/6573* (2013.01); *G03G 2215/00426* (2013.01); *G03G 2215/00616* (2013.01); *G03G 2215/00827* (2013.01)

(58) Field of Classification Search
CPC ..... G03G 15/6573; G03G 2215/00827; G03G 2215/00616; G03G 2215/00426; B65H 2408/122; B65H 2408/121; B65H 2408/12; B65H 2301/51611
USPC ..... 399/407, 404, 410, 397, 405; 271/189, 271/292
See application file for complete search history.

(56) References Cited

U.S. PATENT DOCUMENTS

| | | | | |
|---|---|---|---|---|
| 5,382,016 | A * | 1/1995 | Kobayashi et al. | 271/293 |
| 6,220,592 | B1 * | 4/2001 | Watanabe et al. | 271/241 |
| 6,695,300 | B2 * | 2/2004 | Saito | 270/58.14 |

FOREIGN PATENT DOCUMENTS

| | | |
|---|---|---|
| JP | 2000086064 | 3/2000 |
| JP | 2000169036 | 6/2000 |
| JP | 3556558 | 5/2004 |

* cited by examiner

*Primary Examiner* — Jennifer Simmons
(74) *Attorney, Agent, or Firm* — Gerald E. Hespos; Michael J. Porco; Matthew T. Hespos

(57) ABSTRACT

A stapling section staples a sheet has an opening. The opening has a first open side facing a moving direction of a recording medium moved by the medium moving section and a second open side extending along the moving direction. A shutter is near the second open side in the stapling section. The shutter has a first end axially supported in a freely rotatable manner on an upstream side in the moving direction for arranging the sheet at the stapling position, and a second end portion that hangs down toward the downstream side in the moving direction. When the sheet is not in the stapling section, the second end of the shutter hangs down to block the second open side. When the sheet enters the stapling section through the opening section, the second end of the shutter is pushed up by the axially supported end as the support shaft.

19 Claims, 9 Drawing Sheets

IMAGE FORMING APPARATUS

BACKGROUND OF THE INVENTION

1. Field of the Invention

The present invention relates to an image forming apparatus which forms an image on a recording medium.

2. Description of the Related Art

Conventionally, for the purpose of reducing a space for installation, an image forming apparatus of so-called in-body discharging type has been available which has a sheet-discharging space in a main body of the image forming apparatus for discharging a sheet on which an image is formed. Usually, the sheet-discharging space is open on a front side of the main body of the image forming apparatus, and a user takes out a sheet which is discharged to a tray as a bottom from an open side.

Further, a patent document (Japanese Patent No. 3556558) discloses an image forming apparatus which has a stapler for stapling a sheet in a main body. The image forming apparatus includes a post-processing tray, on which a sheet to be stapled is temporarily placed, on an upper portion in a discharging space.

In the image forming apparatus like the one disclosed in the patent document, the stapler is provided on a front side (front) of the apparatus so that a user can easily replenish staples. Also, in the image forming apparatus, there are provided a pair of pull-over cursors which move a sheet placed on the post-processing tray to a direction which is orthogonal to a sheet conveying direction (forward direction in the apparatus), and the pull-over cursors move in a direction orthogonal to the sheet-conveying direction to arrange the sheet at a stapling position in the stapler. After stapling, the pull-over cursors move again in a direction orthogonal to the sheet-conveying direction (backward direction in the apparatus) to put the sheet back to the original sheet-conveying position. Therefore, the stapler has an opening section which allows movement of the sheet in two directions: the direction perpendicular to the sheet-conveying direction, and the sheet-conveying direction. The sheet enters the stapler along this opening section. However, there is likelihood that an object other than a sheet enters the stapler through the opening section.

SUMMARY OF THE INVENTION

The present invention was made to solve the aforementioned problem, and its object is to prevent entering of an object in to a post-processing apparatus such as a stapler more effectively than the conventional manner.

In summary, according to an aspect of the present invention, an image forming apparatus includes: an image forming section which forms an image on a recording medium; a post-processing tray on which the recording medium is temporarily placed for post-processing with respect to the recording medium on which the image is formed; a conveying section which conveys the recording medium to the post-processing tray; a medium moving section which moves the recording sheet placed on the post-processing tray in a direction which is orthogonal to a conveying direction of the conveying section; a post-processing section which performs the post-processing with respect to the recording medium; an opening section which is formed at a post-processing position in the post-processing section and includes a first opening side facing a moving direction of the recording medium moved by the medium moving section, and a second opening side which extends along the moving direction, the opening section allows movement of the recording medium; and a shutter which is provided near the second opening side and blocks the second opening side, and the shutter allows entering of the recording mediums which is moved by the medium moving section to an area surrounded by the first and second opening sides and blocks the second opening as retreating of the recording medium from the area.

These and other objects, features and advantages of the present invention will become more apparent upon reading of the following detailed description along with the accompanied drawings.

DETAILED DESCRIPTION OF THE PREFERRED EMBODIMENTS

An image forming apparatus and a post-processing apparatus in accordance with an embodiment of the present invention will be described with reference to the drawings. In the following embodiment, a copying machine will be described as an example of the image forming apparatus. However, the image forming apparatus in accordance with the present invention may be applied to image forming apparatuses such as a printer, a copying machine, a facsimile machine, a complex machine having functions of those, and the like.

Figure 1:
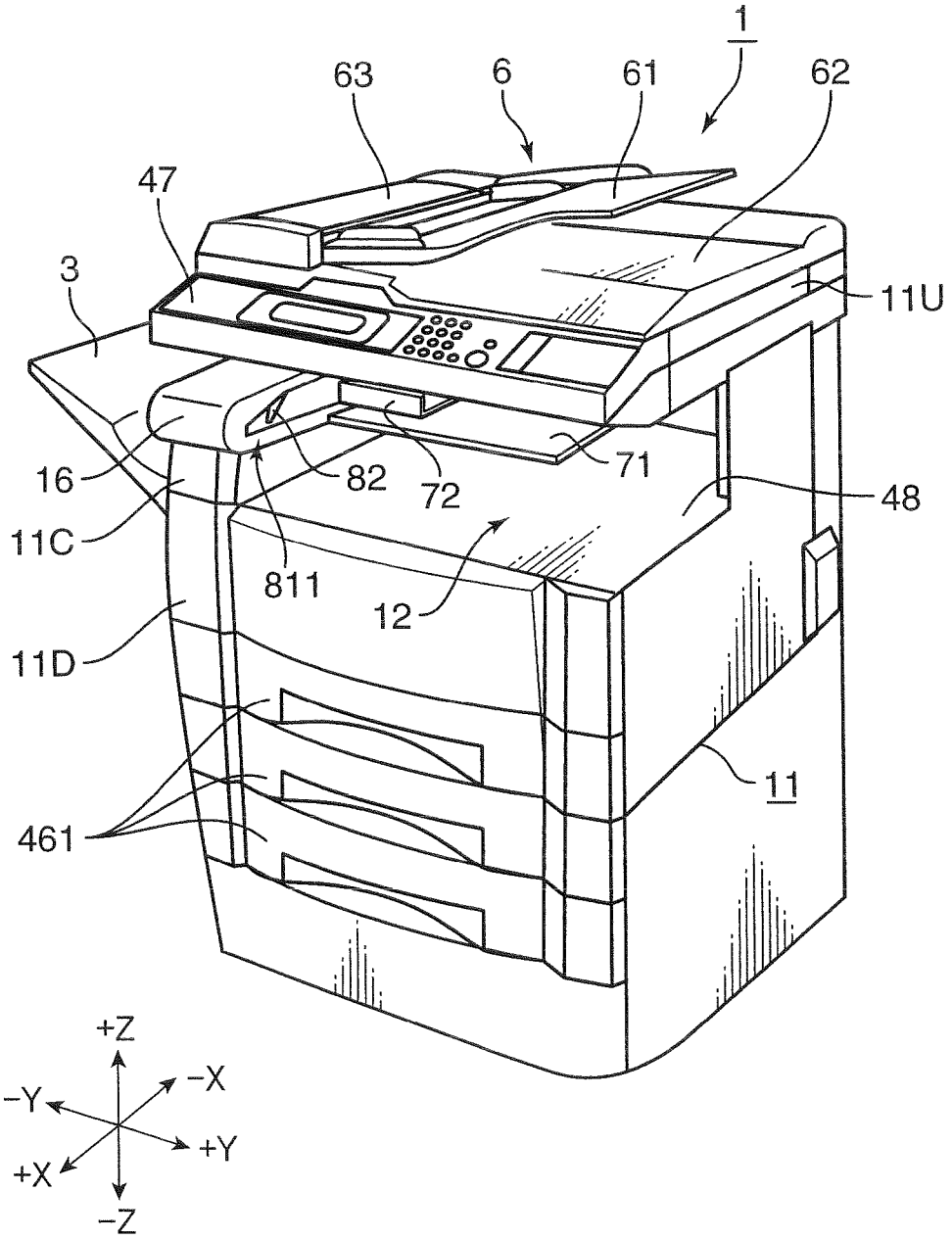
FIG. 1 is a perspective view schematically showing a copying machine.

FIG. 1 is a perspective view schematically showing a copying machine 1 in accordance with an embodiment of the present invention. In the drawing, the forward and backward direction of the apparatus is referred to as X-direction, and the leftward and rightward direction is referred to as Y-direction, and the vertical direction is referred to as Z-direction. The copying machine 1 has, in a vertically mid-portion of a copying machine main body 11 (hereinafter, simply referred to as "main body 11"), a sheet-discharging space 12 which extends inwardly from an external plane of the main body 11 in a substantially horizontal direction. Therefore, the main body 11 includes an upper housing 11U, a lower housing 11D, and a connection housing 11C.

A sheet-discharging section 48 is a tray serving as a bottom of the sheet-discharging space 12, and a sheet which is not stapled is discharged thereonto. A post-processing tray 71 is a tray to which a stapled sheet is conveyed, and it is provided in an upper portion of the sheet-discharging space 12. A pull-over cursor (medium moving section) 72 is adapted to move a sheet in forward and backward direction (X-direction)

of the apparatus when the sheet conveyed to the post-processing tray 71 is to be stapled. At a position facing the pull-over cursor 72 in the X-direction, a pull-over cursor is similarly provided (not illustrated), and these move as a pair of cursors to pull over the sheet. Further, on a side surface of the main body 11, there is provided a sheet-discharging tray 3 to which a stapled sheet is discharged.

The upper housing 11U has a document-supplying section 6 and is provided with an operation panel 47 having operation keys and a display screen on a front side in the X-direction of the upper housing 11U. The lower housing 11D has drawable sheet-feeding cassettes 461 on a front side in the X-direction and further includes a sheet-conveying passage which conveys a sheet taken out from the sheet-feeding cassette 461, an image forming section (image forming section) which transfers a toner image onto a sheet, a fixing section which fixes the toner image transferred to the sheet by the image forming section, and the like.

The connection housing 11C includes a switching guide which switches a destination of the sheet which has passed through the fixing section toward the sheet-discharging section 48 or the post-processing tray 71, a stapling section (post-processing section) 16 which staples the sheet placed on the post-processing tray 71, and a pair of sheet-discharging rollers which discharge the sheet stapled on the post-processing tray 71 to the sheet-discharging tray 3.

Figure 5:
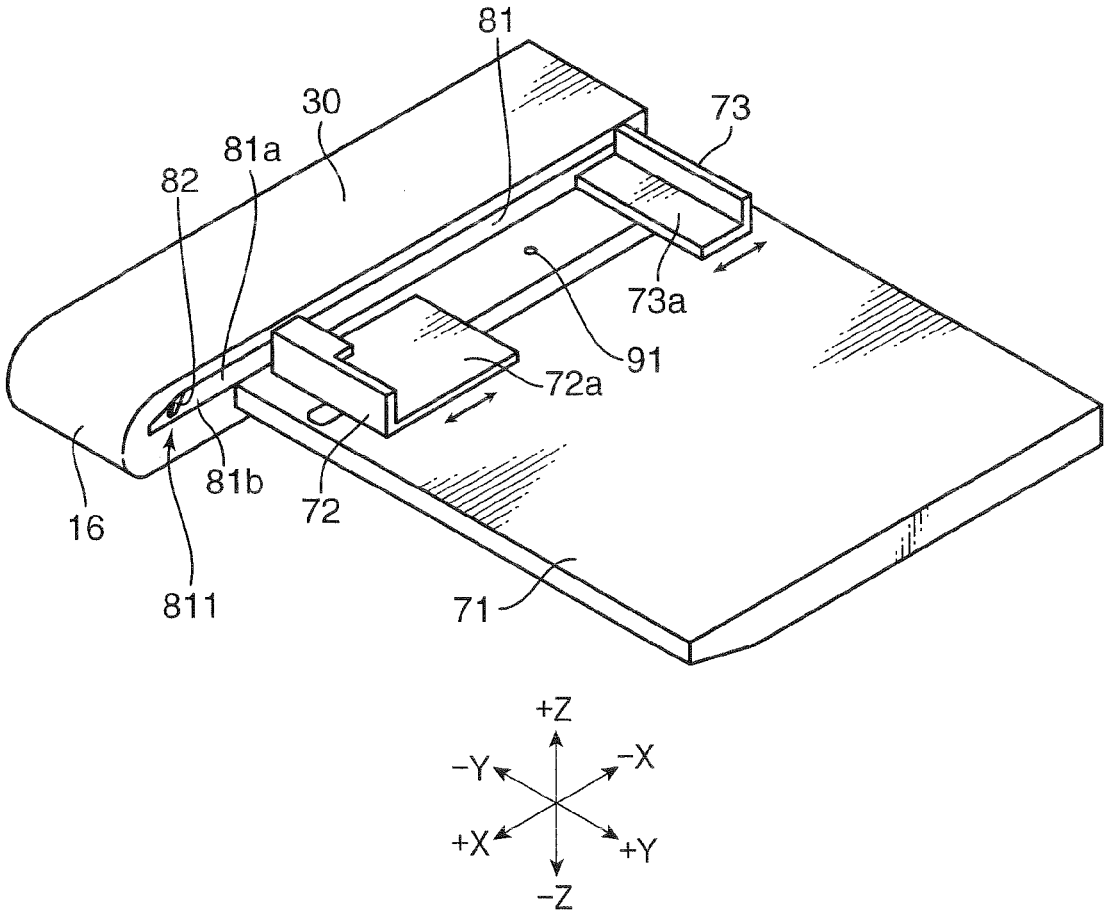
FIG. 5 is a perspective view schematically showing a branching unit and a stapling section.
Figure 6:
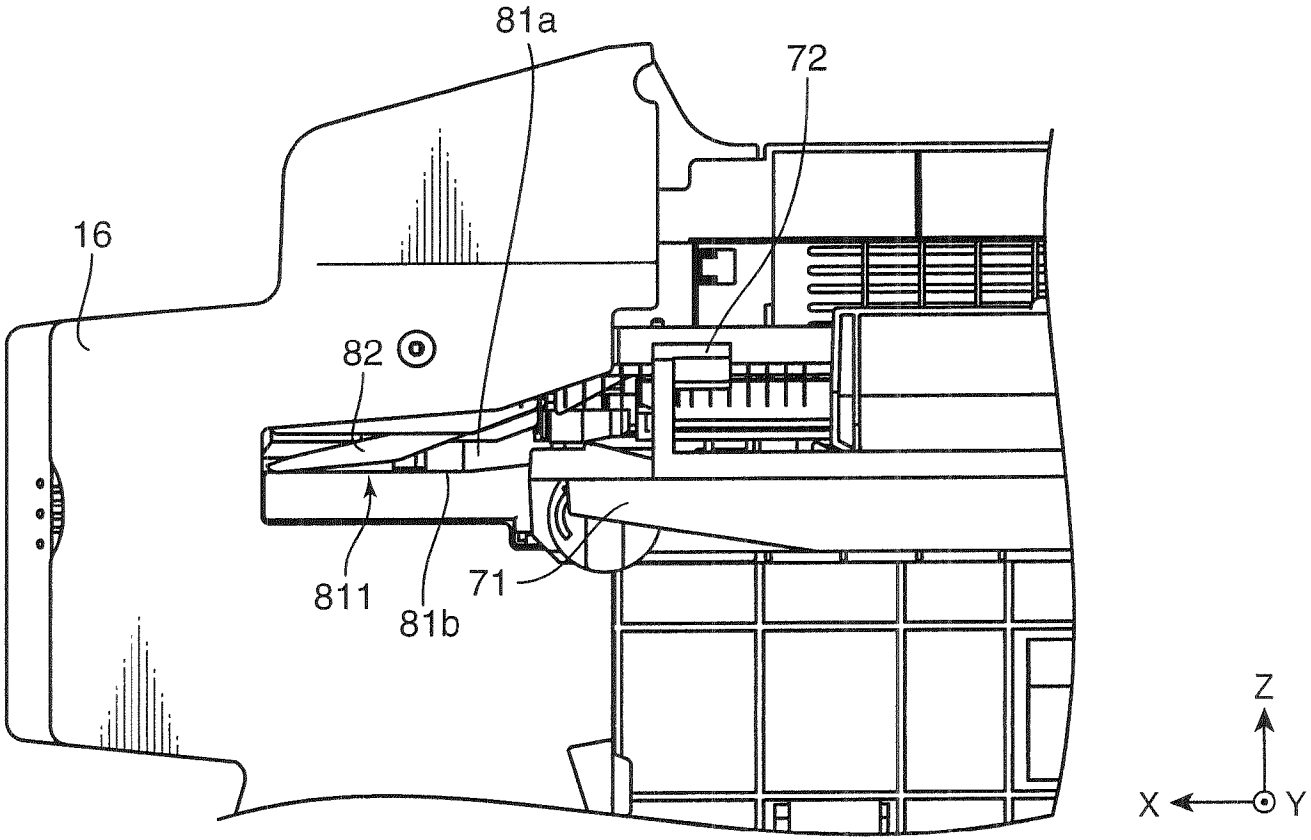
FIG. 6 is a sectional view schematically showing respective parts of the stapling section, the post-processing tray, and the branching unit.

The stapling section 16 has an opening section 81 (FIGS. 5 and 6). The opening section 81 allows the sheet which is discharged by the conveying rollers 36 and 37 (FIG. 2) to pass through in the sheet-discharging direction (conveying direction) toward the post-processing tray 71. Further, the opening section 81 is connected to a stapling position where the stapling section 16 staples a part of the sheet. Near the stapling position, the opening section 81 has (a) a first function of receiving the sheet which is conveyed by the pull-over cursors 72 to the stapling position in view from the stapling position, and (b) a second function of allowing a part of the sheet to protrude from the stapling section 16 in the sheet-discharging direction (conveying direction) when the sheet has moved to the stapling position. Therefore, the opening section 81 has, near the stapling position, a first opening section 81*a* which is open to the direction in which the sheet is moved by the pull-over cursors 72 in view from the stapling position to achieve the first function, and a second opening section 81*b* which is open in the sheet-discharging direction near the stapling position to achieve the second function. The second opening section 81*b*, near the stapling position, has a shape which extends along a direction in which the sheet is moved by the pull-over cursors 72.

Near the second opening section 81*b*, there is provided a shutter 82 which blocks the second opening section 81*b*. One end portion of the shutter 82 is axially supported so as to be freely rotatable, and when the stapling is not performed, the other end portion hangs down so as to block the second opening section 81*b*. When the pull-over cursors 72 move the sheet to enter from the first opening section 81*a* to the stapling position of the stapling section 16, the shutter 82 is pushed up by the sheet, so that the sheet is positioned at the stapling position. The shutter 82 will be described in detail later.

Figure 2:
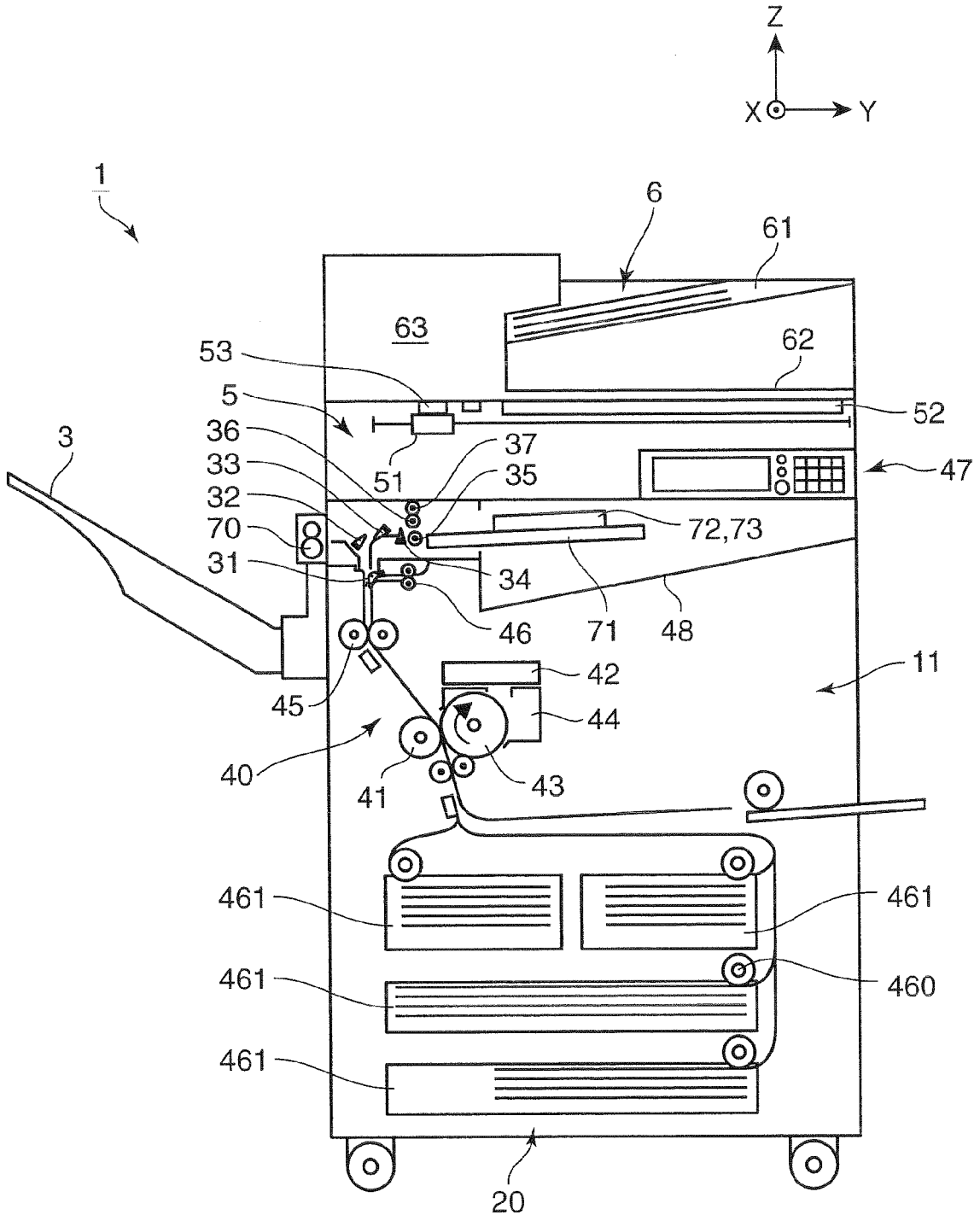
FIG. 2 is a sectional view schematically showing an internal configuration of the copying machine.

FIG. 2 is a sectional view schematically showing an internal configuration of the copying machine 1. The document feeding section 6 a document holding tray 61 on which a document is placed, a document discharging tray 62 to which a document whose image has been read is discharged, and an automatic document feeding apparatus 63 (Auto Document Feeder: hereinafter, referred to as "ADF 63") which includes sheet-feeding roller and conveying rollers (not illustrated) for conveying documents placed on the document holding tray 61 one after another sequentially to the position facing the document reading slit 53 and discharging the same to the document discharging tray 62. The ADF 63 has an unillustrated sheet-reversing mechanism for reversing the document and conveying the same to the position facing the document reading slit 53, so that images on both sides of the document can be read by a scanner 51 through the document reading slit 53.

The document reading section 5 includes the scanner 51 having a CCD (Charge Coupled Device) sensor, an exposure lamp, and the like, a document holder 52 (platen glass) configured by a transparent member such as glass, and a document reading slit 53. The scanner 51 can be moved by an unillustrated driving section, and is moved to a position facing the document holder 52 when a document placed on the document holder 52 is read. The scanner 51 outputs image data which is obtained by scanning a document image to a controller which will be described later. Further, when the document supplied by the document feeding section 6 is read, the scanner 51 is moved to the position facing the document reading slit 53, obtains a document image through the document reading slit 53 in synchronization with a document conveying operation of the document feeding section 6, and then outputs the image data to the controller.

Further, the document feeding section 6 is so configured as to be retractable, so that the document holder 52 can be carried upward to open the upper surface, thus a document to be read, for example, an opened book or the like can be placed on the upper surface of the document holder 52.

The lower housing 11U includes a plurality of sheet-feeding cassettes 461 accommodating sheets of different sizes respectively, sheet-feeding rollers 460 provided respectively above the sheet-feeding cassettes to take out sheets one after another from the sheet-feeding cassettes 461 and convey the same to the image forming section 40, the image forming section 40 which forms a toner image onto a sheet conveyed from the sheet-feeding cassette 461, and a fixing section 45 which fixes the toner image transferred to the sheet.

The image forming section 40 includes an optical unit 42 which outputs a laser light based on the image data obtained by the scanner 51 to the photoconductive drum 43 for exposure, a developing section 44 which forms a toner image on the photoconductive drum 43, a transferring section 41 which transfers the toner image from the photoconductive drum 43 to the sheet. The sheet onto which the toner image is transferred by the image forming section 40 is conveyed by the fixing section 45 having a heating roller and a pressing roller, and the sheet passes through a nip portion between the heating roller and the pressing roller, so that the toner image is fixed on the sheet.

On a downstream side of the fixing section 45, there is provided a switching guide 31. When the switching guide 31 is switched to the state, the sheet conveyed from the fixing section 45 is guided to the side of the sheet-discharging section 48. The sheet guided to the side of the sheet-discharging section 48 is discharged by the pair of sheet-discharging rollers 46 to the sheet-discharging section 48. On the other hand, when the switching guide 31 is switched to the state shown in FIG. 2, the sheet conveyed from the fixing section 45 is conveyed by the conveying rollers 36 and 37 to the post-processing tray 71 via the branching levers 32 and 33.

Figure 3A:
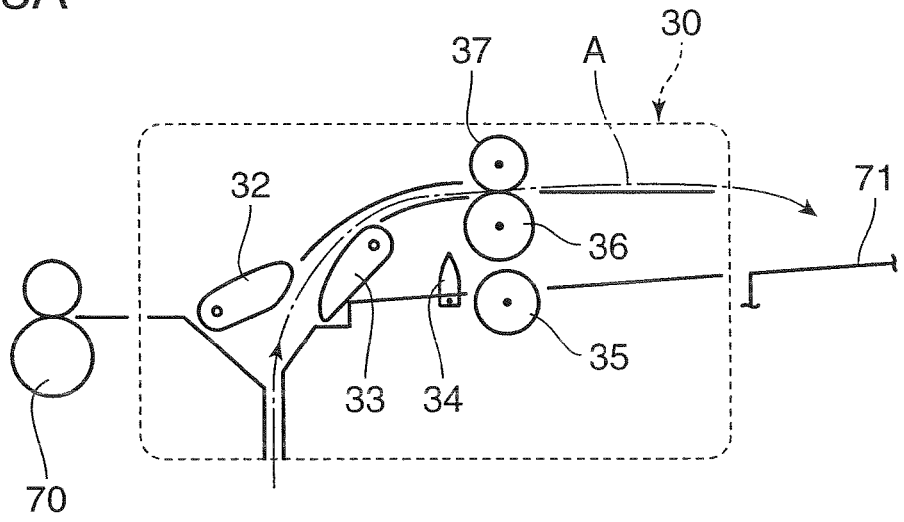
FIG. 3 is an enlarged view showing a conveying passage in which a branching lever is provided.
Figure 3B:
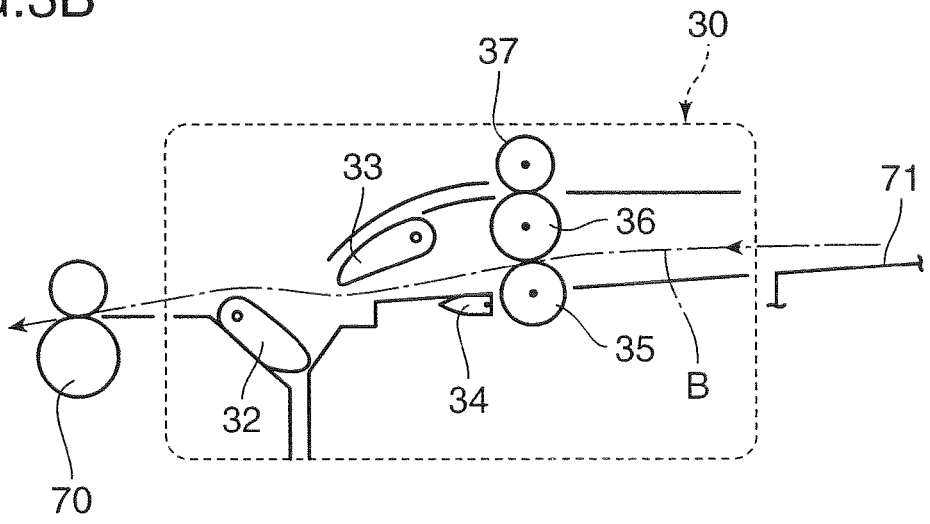

FIGS. 3A and 3B show enlarged views of the conveying passage in which the branching levers 32 and 33 are provided. When the branching levers 32 and 33 are in the state shown in FIG. 3A, the sheet passes through the conveying passage indicated by one-dotted chain line A and is conveyed to the post-processing tray 71 by the conveying rollers 36 and 37 (conveying section). At this time, a stopper 34 stands up to prevent the sheet from passing through the nip portion between the conveying rollers 35 and 36.

The sheet P conveyed to the post-processing tray 71 is stapled, and thereafter the branching levers 32 and 33 are switched to the state shown in FIG. 3B. Then, the sheet is taken out from the post-processing tray 71 by the conveying rollers 35 and 36, passes through the conveying passage indicated by one-dotted chain line B, and then is discharged to the sheet-discharging tray 3 by the pair of sheet-discharging rollers 70.

Figure 4:
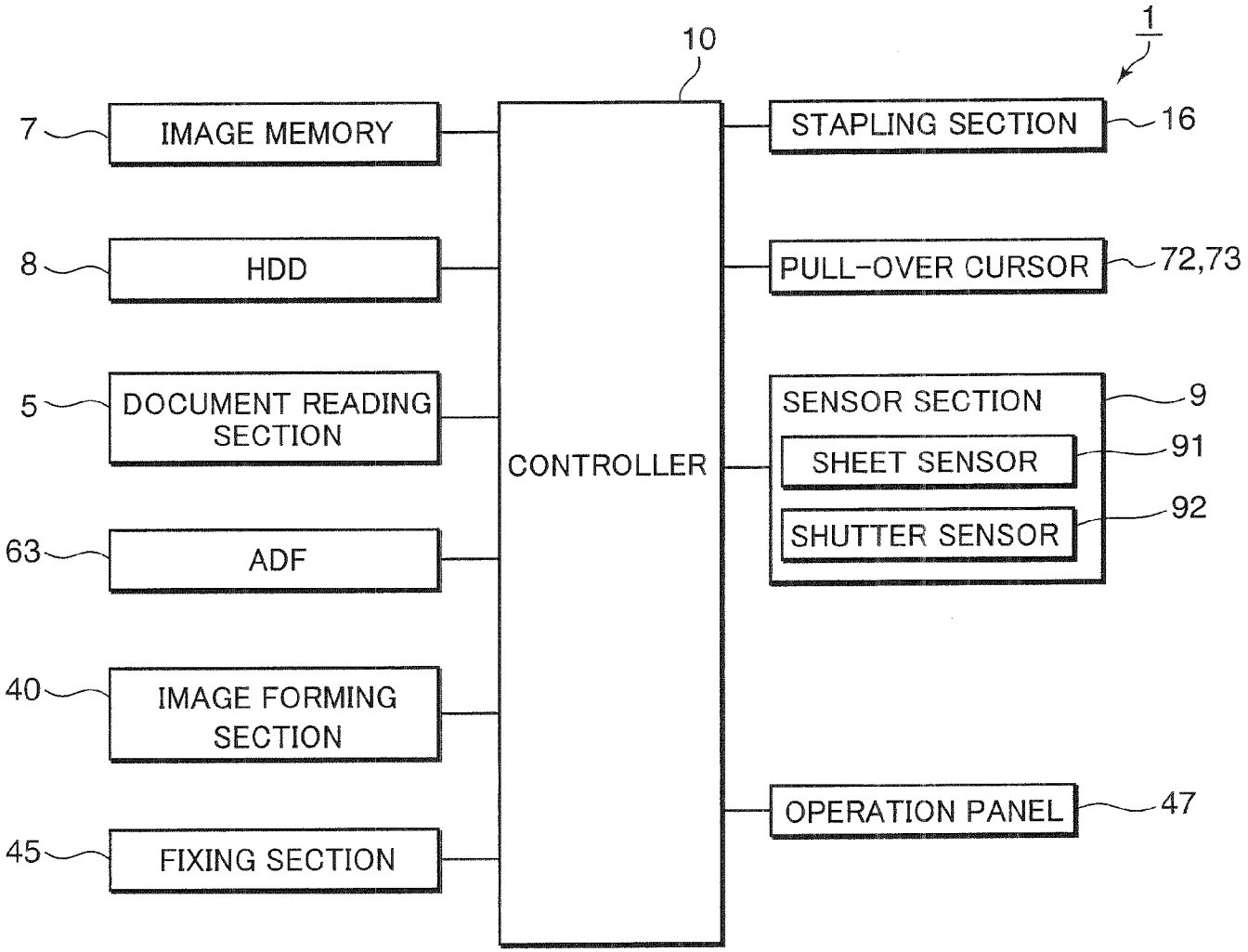
FIG. 4 is a block diagram showing an electric configuration of the copying machine.

FIG. 4 is a block diagram showing an electric configuration of the copying machine 1. The image memory 7 is a memory which temporarily stores data of a document image read by the document reading section 5 (scanner 51). The HDD (Hard Disk Drive) 8 is a storage device which stores image data read by the document reading section 5 and an output format or the like which is set for the image data.

A controller (medium detecting section, shutter detecting section) 10 includes a ROM (Read Only Memory) which stores a control program of the copying machine 1, a RAM (Random Access Memory) which temporarily stores data, and a CPU (Central Processing Unit) which reads the control program or the like from the ROM and executes the same. The controller 10 totally controls the apparatus in accordance with instruction information received at the operation panel 47 and detection signals inputted from sensors provided in respective parts of the apparatus.

The image forming section 40 transfers a toner image onto the sheet in accordance with an instruction signal outputted from the controller 10. The fixing section 45 fixes the toner image transferred to the sheet. The stapling section 16 staples the sheet on which the image is formed. The pull-over cursors 72 and 73, under a control by the controller 10, are moved by an unillustrated motor in the direction orthogonal to the sheet conveying direction. The movement of the pull-over cursors 72 and 73 causes the sheet which has been conveyed to the post-processing tray 71 to move to a stapling position in the stapling section 16. Then, after the stapling is performed, the sheet is moved to the originally conveyed position by the pull-over cursors 72 and 73.

The sensor section 9 includes a sheet sensor 91 which detects whether or not the sheet is placed on the post-processing tray 71 and a shutter sensor 92 which detects whether or not the shutter 82 is pushed up to a predetermined position. The sheet sensor 91 and the shutter sensor 92 will be described in detail later.

Figure 7:
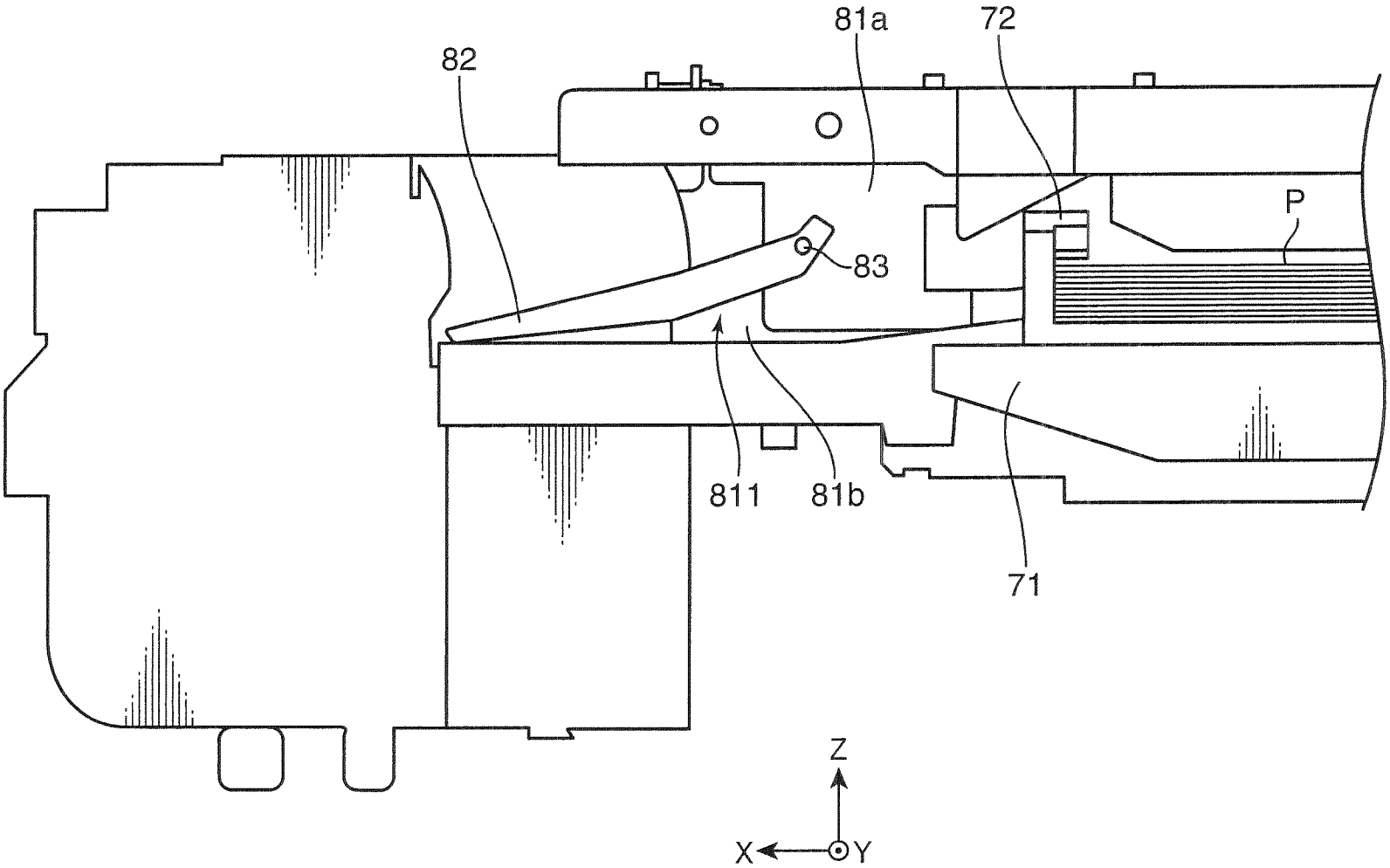
FIG. 7 is a sectional view schematically showing respective parts of the stapling section, the post-processing tray, and the branching unit.
Figure 8:
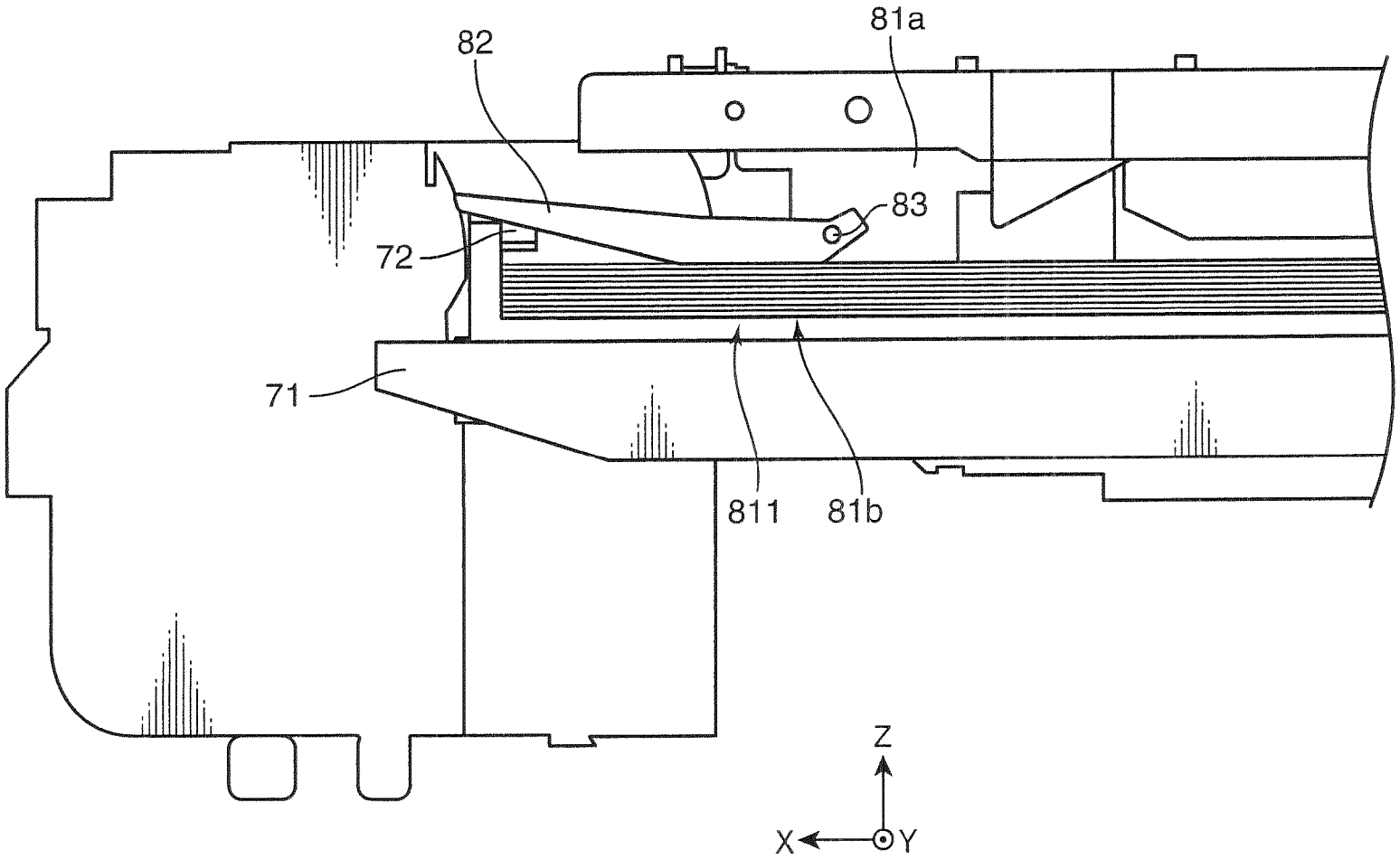
FIG. 8 is a sectional view schematically showing respective parts of the stapling section, the post-processing tray, and the branching unit.

FIG. 5 is a perspective view schematically showing the branching unit 30, which includes the post-processing tray 71, the branching levers 32 and 33, the conveying rollers 35, 36, and 37, and the stapling section 16. Further, FIG. 6 is a sectional view schematically showing parts of the stapling section 16, the post-processing tray 71, and the branching unit 30, viewed from the Y-direction. FIGS. 7 and 8 are sectional views showing the movement of the shutter 82, viewed from the farther side in the −Y direction than the sectional view in FIG. 6. The post-processing tray 71 and the stapling section 16 will be described in detail with reference to FIGS. 5 through 8.

As shown in FIG. 5, the pull-over cursors 72 and 73 are provided on the post-processing tray 71. The sheet guided to the post-processing tray 71 by the branching levers 32 and 33 and discharged through the opening section (conveyance opening section) 81 described later is placed on the placing surfaces 72*a* and 73*a* of the pull-over cursors 72 and 73. Hereinafter, a position of the pull-over cursors 72 and 73 at the time of receiving the sheet discharged through the position opening section 81 will be referred to as a sheet conveyance position. When the sheet is placed on the placing surfaces 72*a* and 73*a* of the pull-over cursors 72 and 73, the pull-over cursors 72 and 73 move the sheet. The pull-over cursors 72 and 73 move in the X direction (a direction toward the front side of the apparatus, forward direction) to allow a portion of the sheet to be stapled to reach a stapling position of the stapling section 16. In other words, the sheet is moved in the direction (X-direction) which is orthogonal to the conveying direction (Y-direction) in which the sheet is discharged through the opening section 81. In other words, the opening section 81 allows movement of the sheet in two directions: the direction (X-direction) orthogonal to the conveying direction (Y-direction); and the conveying direction (Y-direction).

As shown in FIG. 6, in the stapling section 16, a second opening section 81*b* is formed along the moving direction (X-direction) of the sheet moved by the pull-over cursors 72. The movement of the pull-over cursors 72 and 73 in the X-direction by a drive force applied by an unillustrated motor causes the sheet to enter toward the stapling position from the first opening section 81*a* and move along the second opening section 81*b*, so that the portion of the sheet to be stapled is arranged at the stapling position.

Further, as described above, in the opening section 81 of the stapling section 16, the shutter 82 is provided at the second opening section 81*b*. The shutter 82 is adapted to block the second opening section 81*b* defined by the opening section 81 in the conveying direction (Y-direction). As shown in FIG. 7, one end portion, which is positioned on an upstream side in the moving direction of the pull-over cursors 72 and 73 for arranging the sheet at the stapling position, of the shutter 82 is axially supported by a shaft 83 freely rotatably, and the other end portion hangs down toward the downstream side in the moving direction of the sheet P. When the sheet is not in the state of entering the stapling position of the stapling section 16, the other end portion of the shutter 82 is, as shown in FIG. 7, in a hanging posture to block the second opening section 81*b* of the stapling section 16.

The second opening section 81*b* is formed in a portion of the opening section 81 which is exposed from the front side of the main body 11 of the copying machine 1. The shutter 82 blocks the second opening section 81*b* of the opening section 81 at the exposed part 811.

When the sheet P placed on the pull-over cursors 72 and 73 enters the stapling section 16 along the second opening section 81*b* from the sheet conveyance position, a pressure applied by the sheet P causes the one end portion of the shutter 82 to rotate about the shaft 83 as the support shaft, so that the other end portion is pushed up by the sheet, as shown in FIG. 8. Then, the sheet reaches the stapling position. After the stapling is completed, the pull-over cursors 72 and 73 move in the −X direction (rearward direction of the apparatus) to go back to the original sheet conveyance position. When the sheet moves out of the stapling position of the stapling section 16 along the second opening section 81*b*, the other end portion of the shutter 82 hangs down as shown in FIG. 7, and falls in the posture of blocking the second opening section 81*b*.

When the sheet which is moved by the pull-over cursors 72 and 73 in the opening section 81 comes in contact with the shutter 82 as described above, and the one end portion of the shutter 82 rotates about the shaft 83 as the support shaft, the shutter 82 and the sheet in contact with the shutter 82 block the exposed part 811 of the second opening section 81*b*.

As described above, when the sheet is not in the state of entering the stapling section 16, the shutter 82 falls in a posture of blocking the second opening section 81*b* of the opening section 81, so that entering of an object other than the sheet into the stapling section 16 from the second opening section 81*b* of the opening section 81 can be prevented. Thus, failure of the stapling section 16 due to entering of the object can be prevented.

When the sheet on the post-processing tray 71 is not detected by the sheet sensor (medium detecting section) 91 provided on the post-processing tray 71, and the shutter sensor (shutter detecting section) 92 detects that the other end portion of the shutter 82 has moved to the predetermined position, the stapling section 16 does not perform stapling.

As shown in FIG. 5, the sheet sensor 91 is provided at the surface on the post-processing tray 71 where the pull-over cursors 72 and 73 are arranged. For example, the sheet sensor 91 is provided in an area between the pull-over cursors 72 and 73 at the sheet conveyance position. The sheet sensor 91 is configured by, for example, a reflective optical sensor and has a light emitting device and a light receiving device. In a case where the sheet is placed on the pull-over cursors 72 and 73, the light emitted from the light emitting device is reflected by the sheet, and the light receiving device receives the reflected light and outputs a light-reception signal to the controller 10. Accordingly, the controller 10 identifies that the sheet is placed on the pull-over cursors 72 and 73. On the other hand, in the case where the sheet is not placed on the pull-over cursors 72 and 73, the light receiving device does not receive the reflected light and thus does not output a light reception signal. Thus, the controller 10 identifies that the sheet is not placed on the post-processing tray 71.

The sheet sensor 91 is not limited to the aforementioned configuration. For example, the sheet sensor 91 may be provided inside the stapling section 16. In particular, the sheet sensor 91 may be provided near the stapling position or the opening section 81 and on an upstream side from the stapling position in the moving direction of the pull-over cursors 72 and 73 for arranging the sheet at the stapling position. Further, a weight sensor may measure the weight of the pull-over cursors 72 and 73 to determine whether or not the sheet is placed on the placing surface 72*a* and 73*a*.

Figure 9A:
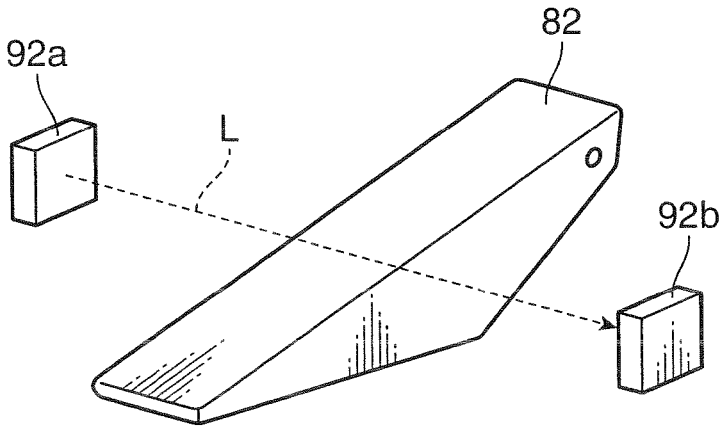
FIG. 9 is an explanatory drawing showing a shutter sensor.
Figure 9B:
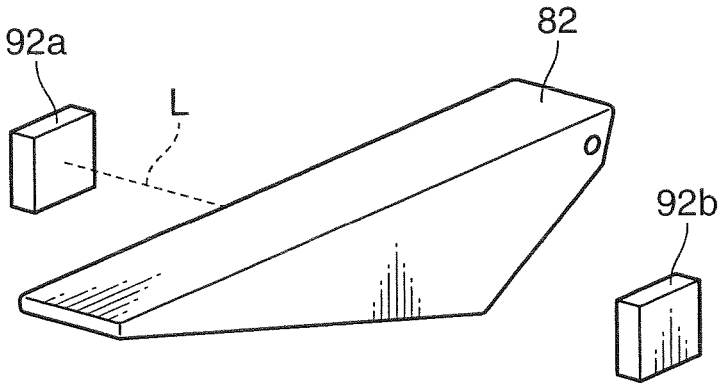

FIGS. 9A and 9B are explanatory drawings showing the shutter sensor 92. The shutter sensor 92 is configured by, for example, a transmission type optical sensor, and there are provided a light emitting device 92*a* and a light receiving device 92*b* across the other end portion in a state where the other end portion of the shutter 82 is in a posture at the predetermined position due to the entering of the sheet. When the other end of the shutter 82 hangs down, a light L emitted from the light emitting device 92*a* enters the light receiving device 92*b*, and the light receiving device 92*b* outputs a light reception signal to the controller 10. On the other hand, when the other end portion of the shutter 82 moves, the light L emitted from the light emitting device 92*a* is shut by the shutter 82. Therefore, the light L does not enter the light receiving device 92*b*. Thus, since the light receiving device 92*b* does not output a light reception signal to the controller 10, the controller 10 identifies that the other end portion of the shutter 82 is at the predetermined position.

Normally, the sheet moved by the pull-over cursors 72 and 73 enters the stapling section 16, and the other end portion of the shutter 82 moves. At this time, a light reception signal is outputted from the sheet sensor 91, and a light reception signal is not outputted from the shutter sensor 92. Therefore, the controller 10 identifies that the sheet placed on the post-processing tray 71 enters the stapling section 16 and is pushed up by the shutter 82. Then, the controller 10 outputs to the stapling section 16 an instruction signal of performing stapling.

On the other hand, when a light reception signal is not outputted from the shutter sensor 92 and the sheet sensor 91, the controller 10 identifies that the other end portion of the shutter 82 is moved, regardless of that the sheet is not placed on the post-processing tray 71. In other words, the controller 10 identifies that the shutter 82 is pushed up by an object other than the sheet (such as an external object), and outputs an instruction signal of not allowing the stapling section 16 to perform stapling. As described above, in a case where an object other than the sheet enters the stapling section 16, the controller 10 performs a control of not allowing the stapling to be performed, so that failure of the stapling section 16 can be prevented.

The shutter sensor 92 is not limited to the configuration described above. For example, the shutter sensor 92 may detect the rotation of the shutter 82 by detecting a rotational angle of the shaft 83, or may detect that the other end portion is pushed to a predetermined position in accordance with pressing of a switch by the other end portion of the shutter 82.

Further, as shown in FIG. 7, the shutter 82 has a tapered shape which becomes thinner from the one end portion to the other end portion at the contact surface with respect to the sheet. In particular, the contact surface of the shutter 82 with the sheet has two-step slope portions including a first slope portion and a second slope portion. In a state where the shutter 82 hangs down, the first slope portion formed on the side of the one end portion of the shutter 82 has a larger slope angle with respect to the sheet placing surface of the post-processing tray 71 than the second slope portion formed on the side of the other end portion. As described above, making the shutter 82 have a shape having a slope which is large on the upstream side (one end portion of the shutter 82) in the moving direction of the pull-over cursors 72 and 73 to the sheet stapling position causes an entrance opening section for the sheet to be wider, so that the sheet can smoothly enter under the shutter 82.

The present invention is not limited to the present embodiment. For example, other than the above-described stapling section 16, the post-processing section may be a punching section for forming a punch hole in the sheet, a sorting section which shifts the sheet in a direction orthogonal to the sheet conveying direction by a predetermined distance, and the like.

In summary, an image forming apparatus in accordance with an aspect of the present invention includes: an image forming section which forms an image on a recording medium; a post-processing tray on which the recording medium is temporarily placed for post-processing with respect to the recording medium on which the image is formed; a conveying section which conveys the recording medium to the post-processing tray; a medium moving section which moves the recording sheet placed on the post-processing tray in a direction which is orthogonal to a conveying direction of the conveying section; a post-processing section which performs the post-processing with respect to the recording medium; an opening section which is formed at a post-processing position in the post-processing section and includes a first opening side facing a moving direction of the recording medium moved by the medium moving section, and a second opening side which extends along the moving direction, the opening section allows movement of the recording medium; and a shutter which is provided near the second opening side and blocks the second opening side, and the shutter allows entering of the recording mediums which is moved by the medium moving section to an area surrounded by the first and second opening sides and blocks the second opening as retreating of the recording medium from the area.

Further, according to an aspect of the present invention, the shutter has one end portion which is rotatably and axially supported on an upstream side in the moving direction of the recording medium moved by the medium moving section and the other end portion which hangs down toward a downstream side in the moving direction, and blocks the second opening side, and the recording medium which is moved by the medium moving section in the opening section comes in contact with the shutter at the time of entering the area, so that the other end portion of the shutter moves around the axially supported one end portion as a support shaft.

Further, a post-processing apparatus in accordance with an aspect of the present invention is a post-processing apparatus which performs a post-processing with respect to a recording medium on which an image is formed, and the post-processing apparatus includes: a post-processing tray on which the recording medium is temporarily placed; a post-processing section which performs the post-processing with respect to the recording medium; a medium moving section which moves the recording medium on the post-processing tray in a direction perpendicular to a conveying direction of conveying the recording medium between a receiving position for receiving the recording sheet from the conveying section and a post-processing position at which the post-processing is performed by the post-processing section; an opening section which is formed at the post-processing position in the post-processing section and includes a first opening side facing a moving direction of the recording medium moved by the medium moving section, and a second opening side which extends along the moving direction, the opening section allows movement of the recording medium; and a shutter which is provided near the second opening side and blocks the second opening side, and the shutter allows entering of the recording mediums which is moved by the medium moving section into an area surrounded by the first and second opening sides and blocks the second opening as retreating of the recording medium from the area.

Further, according to the post-processing apparatus in accordance with an aspect of the present invention, the shutter has one end portion which is rotatably and axially supported on an upstream side in the moving direction of the recording medium moved by the medium moving section and the other end portion which hangs down toward a downstream side in the moving direction, and blocks the second opening side, and the recording medium which is moved by the medium moving section in the opening section comes in contact with the shutter at the time of entering the area, so that the other end portion of the shutter moves around the axially supported one end portion as a support shaft.

According to these inventions, when the sheet is not in the post-processing section, the other end portion of the shutter hangs down to take a posture of closing the opening section of the post-processing section. Accordingly, entering of an object other than the sheet from the opening section into the post-processing section can be prevented.

Further, according to an aspect of the present invention, the opening section extends in a direction which is orthogonal to the conveying direction, and the medium moving section moves the recording medium on the post-processing tray between a receiving position for receiving the recording medium from the conveying section and a post-processing position at which the post-processing is performed by the post-processing section, and the second opening side is so provided as to be exposed from a main body of the image forming apparatus, and the shutter blocks the second opening side when the recording medium is in a state of being at the receiving position.

Further, according to the post-processing apparatus in accordance with an aspect of the present invention, in the moving direction, the second opening side of the opening section is so shaped as to be exposed to outside when the recording medium is at the receiving position, and the shutter blocks the second opening when the recording medium is at the receiving position.

According to these inventions, the shutter is provided at the part exposed from the main body of the image forming apparatus. Accordingly, entering of an object can be effectively prevented at a part which is likely to allow entering of an object from outside into the post-processing section.

Further, according to an aspect of the present invention, when the recording medium moved by the medium moving section in the opening section toward the post-processing position comes in contact with the shutter, and the shutter is rotated about the axially supported one end portion as the support shaft, the shutter and the recording medium in contact with the shutter block the exposed second opening side.

According to this invention, the recording medium is moved by the medium moving section to come in contact with the shutter, and even if the shutter is rotated by this, the shutter and the recording medium block the opening section at the exposed part. Accordingly, at the time of the movement of the recording medium, entering of an object in a part at which an object can easily enter the post-processing section from outside can be prevented effectively during the post-processing with respect to the recording medium is performed.

Further, according to an aspect of the present invention, there are further provided an medium detecting section which detects whether or not the recording medium is placed on the post-processing tray; and a shutter detecting section which detects whether or not the other end portion of the shutter is moved to reach a predetermined position, and when the medium detecting section detects that the recording medium is not placed on the post-processing tray, and the shutter detecting section detects that the other end of the shutter is moved to reach the predetermined position, the post-processing section does not perform the post-processing.

According to this invention, the post-processing with respect to an object which enters through the opening section can be prevented, and failure of the post-processing section due to the object can be prevented.

Further, according to an aspect of the present invention, the shutter has, in a contact surface with respect to the recording medium, a first slope portion formed on the one end portion and a second slope portion formed on the other end portion, and the first slope portion has a larger slope angle with respect to a surface on which the recording medium is placed than the second slope portion in a state where the other end portion of the shutter hangs down.

According to this invention, the entrance opening section on the side of the one end portion of the shutter corresponding to the upstream side in the moving direction of the medium moving section at the time of allowing the sheet to enter along the opening section of the post-processing section is formed to be wide, so that the recording medium can smoothly enter under the shutter.

This application is based on Japanese Patent application serial No. 2008-014561 filed in Japan Patent Office on Jan. 25, 2008, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus comprising:

an image forming section that forms an image on a recording medium;

a post-processing tray on which the recording medium is temporarily placed for post-processing with respect to the recording medium on which the image is formed;

a sheet-discharging tray to which a post-processed sheet is discharged;

a branching unit that includes:

a casing with first and second casing sections integrated therein, the first casing section having a conveyance opening facing the post-processing tray, a conveying passage in the first casing section and accommodating movement of the recording medium, a conveying section in the first casing section and conveying the recording medium in a first direction along the conveying passage to the post-processing tray, and a branching lever provided in the first casing section along the conveying passage and configured for guiding the recording medium to be post-processed to the post-processing tray and then guiding the post-processed recording medium from the post-processing tray to the sheet-discharging tray;

a medium moving section that moves the recording medium placed on the post-processing tray in a second direction orthogonal to said first direction of the conveying section;

a post-processing section in the second casing section and including a post-processing device that performs a post-processing operation with respect to the recording medium at a post-processing position, the second casing section including:

a first opening portion that opens to the conveying passage in the first casing section to receive therein a part of the recording medium moved by the medium moving section, a second opening portion that defines a continuation of the conveyance opening and extends from one end of the first opening portion to a predetermined position along the second direction and that allows movement of the recording medium, the second casing section having no opening portion other than the first opening portion for allowing the recording sheet to enter the post-processing position in the second direction; and a shutter near the second opening portion, the shutter having a length extending from a position in proximity to the one end of the first opening portion substantially to the predetermined position of the second opening portion along said second direction, the shutter allowing the recording medium that is moved along said second direction by the medium moving section to enter an area surrounded by the first and second opening portions and prevents entry of an object into the post-processing position from the second opening portion along said first direction as the recording medium retreats from the area.

2. The image forming apparatus according to claim 1, wherein the shutter has a first end portion that is rotatably and axially supported on an upstream side in the second direction of movement of the recording medium moved by the medium moving section and a second end portion that hangs down toward a downstream side in the second direction of movement of the recording medium and blocks the second opening portion, and the recording medium, which is moved by the medium moving section in the opening section, comes in contact with the shutter at the time of entering the area, so that the second end portion of the shutter moves around the axially supported first end portion as a support shaft.

3. The image forming apparatus according to claim 2, wherein the opening section extends in a direction orthogonal to the first direction, and the medium moving section moves the recording medium on the post-processing tray between a receiving position for receiving the recording medium from the conveying section and a post-processing position at which the post-processing is performed by the post-processing section, and the second opening portion is so provided as to be exposed from a main body of the image forming apparatus, and the shutter blocks the second opening portion when the recording medium is at the receiving position.

4. The image forming apparatus according to claim 3, wherein when the recording medium moved by the medium moving section in the opening section toward the post-processing position comes in contact with the shutter, and the shutter is rotated about the axially supported first end portion as the support shaft, the shutter and the recording medium in contact with the shutter block the exposed second opening portion.

5. The image forming apparatus according to claim 2, further comprising:

a medium detecting section that detects whether or not the recording medium is placed on the post-processing tray; and a shutter detecting section that detects whether or not the second end portion of the shutter is moved to reach a predetermined position, wherein when the medium detecting section detects that the recording medium is not placed on the post-processing tray, and the shutter detecting section detects that the second end of the shutter is moved to reach the predetermined position, the post-processing section does not perform the post-processing.

6. The image forming apparatus according to claim 1, further comprising:

an medium detecting section that detects whether or not the recording medium is placed on the post-processing tray; and a shutter detecting section that detects whether or not the second end portion of the shutter is moved to reach a predetermined position, wherein when the medium detecting section detects that the recording medium is not placed on the post-processing tray, and the shutter detecting section detects that the second end of the shutter is moved to reach the predetermined position, the post-processing section does not perform the post-processing.

7. The image forming apparatus according to claim 1, wherein the shutter has, in a contact surface with respect to the recording medium, a first slope portion formed on the first end portion and a second slope portion formed on the second end portion, and the first slope portion has a larger slope angle with respect to a surface on which the recording medium is placed than the second slope portion in a state where the second end portion of the shutter hangs down.

8. The image forming apparatus according to claim 1, wherein the shutter is pivotal about an axis substantially parallel to the first direction.

9. The image forming apparatus according to claim 1, further comprising:

an operation panel having operation keys and a display screen; and a main body housing that houses the image forming section, the main body housing including a front side that is provided with the operation panel, wherein the second casing projects forward from the front side of the main body housing, and the second opening portion is exposed from the front side of the main body housing.

10. A post-processing apparatus that performs a post-processing with respect to a recording medium on which an image is formed, the post-processing apparatus comprising:

a post-processing tray for temporarily supporting the recording medium conveyed onto the post-processing tray along a first direction;

a sheet-discharging tray to which a post-processed sheet is discharged;

a branching unit that includes:

a casing with first and second casing sections integrated therein, the first casing section having a conveyance opening facing the post-processing tray, a conveying passage in the first casing section and accommodating movement of the recording medium, and a branching lever provided in the first casing section along the conveying passage and configured for guiding the recording medium to be post-processed to the post-processing tray and then guiding the post-processed recording medium from the post-processing tray to the sheet-discharging tray;

a post-processing section in the second casing section and including a post-processing device that performs a post-processing operation with respect to the recording medium at a post-processing position;

a medium moving section that moves the recording medium on the post-processing tray in a second direction perpendicular to the first direction between a receiving position at which the recording sheet is conveyed onto the post-processing tray and a post-processing position at which the post-processing is performed by the post-processing section;

the second casing section including a first opening portion facing the second direction of movement of the recording medium moved by the medium moving section, and a second opening portion that defines a continuation of the conveyance opening and extends from one end of the first opening portion to a predetermined position along the second direction and that allows movement of the recording medium to the post-processing position, and the second casing having no opening portion other than the first opening portion for allowing the recording sheet to enter the post-processing position in the second direction; and a shutter near the second opening portion, the shutter having a length extending from a position in proximity to the one end of the first opening portion substantially to the predetermined position of the second opening portion along the second direction and allowing the recording medium that is moved along the second direction by the medium moving section to enter into an area surrounded by the first and second opening portions and prevents entry of an object into the post-processing position from the second opening portion along the first direction as the recording medium retreats from the area.

11. The post-processing apparatus according to claim 10, wherein the shutter has a first end portion that is rotatably and axially supported on an upstream side in the second direction of movement of the recording medium moved by the medium moving section and a second end portion that hangs down toward a downstream side in the second direction, and blocks the second opening portion, and the recording medium, which is moved by the medium moving section in the opening section, comes in contact with the shutter at the time of entering the area, so that the second end portion of the shutter moves around the axially supported first end portion as a support shaft.

12. The post-processing apparatus according to claim 11, further comprising:

a medium detecting section that detects whether or not the recording medium is placed on the post-processing tray; and a shutter detecting section that detects whether or not the second end portion of the shutter is moved to reach a predetermined position, wherein when the medium detecting section detects that the recording medium is not placed on the post-processing tray, and the shutter detecting section detects that the second end of the shutter is moved to reach the predetermined position, the post-processing section does not perform the post-processing.

13. The post-processing apparatus according to claim 10, wherein the second opening portion of the opening section is shaped to be exposed to outside when the recording medium is at the receiving position, and the shutter blocks the second opening portion when the recording medium is at the receiving position.

14. The post-processing apparatus according to claim 13, wherein when the recording medium moved by the medium moving section in the opening section toward the post-processing position comes in contact with the shutter, and the shutter is rotated about the axially supported first end portion as the support shaft, the shutter and the recording medium in contact with the shutter block the exposed second opening portion.

15. The post-processing apparatus according to claim 13, further comprising:

a medium detecting section that detects whether or not the recording medium is placed on the post-processing tray; and a shutter detecting section that detects whether or not the second end portion of the shutter is moved to reach a predetermined position, wherein when the medium detecting section detects that the recording medium is not placed on the post-processing tray, and the shutter detecting section detects that the second end of the shutter is moved to reach the predetermined position, the post-processing section does not perform the post-processing.

16. The post-processing apparatus according to claim 10, wherein the shutter has, in a contact surface with respect to the recording medium, a first slope portion formed on the first end portion and a second slope portion formed on the second end portion, and the first slope portion has a larger slope angle with respect to a surface on which the recording medium is placed than the second slope portion in a state where the second end portion of the shutter hangs down.

17. The post-processing apparatus according to claim 10, wherein the shutter is pivotal about an axis substantially parallel to the first direction.

18. An image forming apparatus, comprising:

an image forming section that forms an image on a recording medium;

a post-processing tray on which the recording medium temporarily is placed for post-processing with respect to the recording medium on which the image is formed;

a sheet-discharging tray to which a post-processed sheet is discharged;

a branching unit that includes:

a casing with first and second casing sections integrated therein, the first casing section having a conveyance opening facing the post-processing tray, a conveying passage in the first casing section and accommodating movement of the recording medium, a conveying section in the first casing section and conveying the recording medium in a first direction along the conveyance passage to the post-processing tray, and a branching lever provided in the first casing section along the conveying passage and configured for guiding the recording medium to be post-processed to the post-processing tray and then guiding the post-processed recording medium from the post-processing tray to the sheet-discharging tray;

a medium moving section that moves the recording medium placed on the post-processing tray in a second direction orthogonal to the first direction;

a post-processing section in the second casing section and including a post-processing device that performs a post-processing operation with respect to the recording medium at a post-processing position;

the second casing section including:

a first opening portion that is open to the conveying passage in the first casing section to receive a part of the recording medium moved therein by the medium moving section, a second opening portion that defines a continuation of the conveyance opening and extends from one end of the first opening portion to a predetermined position along the second direction and allows movement of the recording medium, and the second casing section having no opening portion other than the first opening portion for allowing the recording sheet to enter the post-processing position in the second direction; and a shutter near the second opening portion, the shutter having a length extending from a position in proximity to the one end of the first opening portion substantially to said predetermined position of the second opening portion along the second direction, the shutter having a first end portion on an upstream side along the second direction and a second end portion on a downstream side along the second direction, the first end portion being rotatable around a shaft extending in the first direction and the second end portion hanging down toward the downstream side to prevent an external object from coming into the post-processing position along the first direction, the shutter being rotatable around the shaft to allow the recording medium to enter the second opening portion along the second direction for the post-processing with the second end portion of said shutter being moved up by the recording medium coming into contact therewith when the recording medium is conveyed by the medium moving section along the second direction.

19. The image forming apparatus according to claim 18, wherein the shutter is pivotal about an axis substantially parallel to the first direction.

* * * * *